United States Patent [19]

Terzian et al.

[11] 4,072,429

[45] Feb. 7, 1978

[54] PAINT ROLLER

[75] Inventors: Rouben T. Terzian, Chicago; Derek A. Brand, Naperville, both of Ill.

[73] Assignee: Marvin Glass & Associates, Chicago, Ill.

[21] Appl. No.: 610,119

[22] Filed: Sept. 4, 1975

[51] Int. Cl.[2] ..... B43K 5/02; B44D 3/28

[52] U.S. Cl. ..... 401/146; 401/208

[58] Field of Search ..... 401/146, 208, 188, 203, 401/204, 207, 219, 220, 48; 417/477

[56] References Cited

U.S. PATENT DOCUMENTS

| | | | |
|---|---|---|---|
| 2,955,310 | 10/1960 | Wichen | 401/219 |
| 3,101,675 | 8/1963 | Isreeli | 417/477 |
| 3,195,170 | 7/1965 | Howard | 401/188 |
| 3,230,570 | 1/1966 | Flippen | 401/146 |
| 3,274,637 | 9/1966 | Schulze | 401/15 X |
| 3,310,831 | 3/1967 | Brinker | 401/188 X |
| 3,441,355 | 4/1969 | Brown | 401/208 |
| 3,447,478 | 6/1969 | Clemens | 417/477 |
| 3,457,017 | 7/1969 | Rastian | 401/197 X |
| 3,822,948 | 7/1974 | Handl | 401/146 |

FOREIGN PATENT DOCUMENTS

| | | | |
|---|---|---|---|
| 680,716 | 1/1965 | Italy | 401/219 |

*Primary Examiner*—Stephen C. Pellegrino

[57] ABSTRACT

An apparatus is provided for applying fluid material such as paint to a surface. In the illustrative embodiment the apparatus comprises a wheeled carriage which can be moved along a floor or other support surface and the applicator is an absorbent paint roller. The carriage includes a well for receiving a paint pail and also includes a pump and a conduit for delivering paint from the paint pail to the paint roller. At the paint roller the paint is distributed by a manifold having varying sized ports along the length of the paint roller so as to distribute paint onto the paint roller evenly along its length. More specifically the supply conduit delivers paint to the center of the manifold and the paint flows laterally along the length of the manifold and exits onto the applicator through the ports. The central ports are smaller than the end ports and gradually increase in size toward the ends of the manifold to accommodate differences in pressure within the manifold and assure a more even distribution of the paint along the length of the roller.

13 Claims, 11 Drawing Figures

PAINT ROLLER

BACKGROUND OF THE INVENTION

1. Field of the Invention

The present invention relates to a device for applying paint or other fluid material to a surface and more particularly to an improvement in such a device including a paint pail carriage and a system for pumping paint from a pail in the carriage to the surface of a paint roller or other applicator.

2. Brief Description of the Prior Art

U.S. Pat. Nos. 3,457,017 and 3,822,948 describe systems for delivering paint to a roller using a peristaltic pump. In the U.S. Pat. No. 3,457,017, the paint is delivered to a recess within the roller for application to a surface. In the U.S. Pat. No. 3,822,948, the paint is delivered to a distribution system adjacent the roller for distributing the paint along the length of the roller. However, neither of these systems provides a handy, readily portable paint pail carriage unit which can be used by the ordinary homeowner and can be compactly stored after use. Neither system provides for accurate even distribution of paint across the width of an applicator. Also the prior art does not provide for sufficiently convenient cleaning of the applicator system to suit the normal home owner.

SUMMARY OF THE INVENTION

The invention herein provides a new and useful apparatus for applying paint or other fluid material to a surface. The apparatus includes a portable case or carriage having a well for receiving a paint pail a conduit and pump means for delivering paint from the paint pail through the conduit to an applicator, such as a paint roller. At the applicator, a manifold receives the paint from the conduit and distributes the paint evenly over the width of the applicator surface.

While this invention is susceptible of embodiment in many different forms, there is shown in the drawings and will herein be described in detail a specific embodiment thereof, with the understanding that the present disclosure is to be considered as an exemplification of the principles of the invention and is not intended to limit the invention to the embodiment illustrated.

DESCRIPTION OF THE PREFERRED EMBODIMENT

Figure 1:
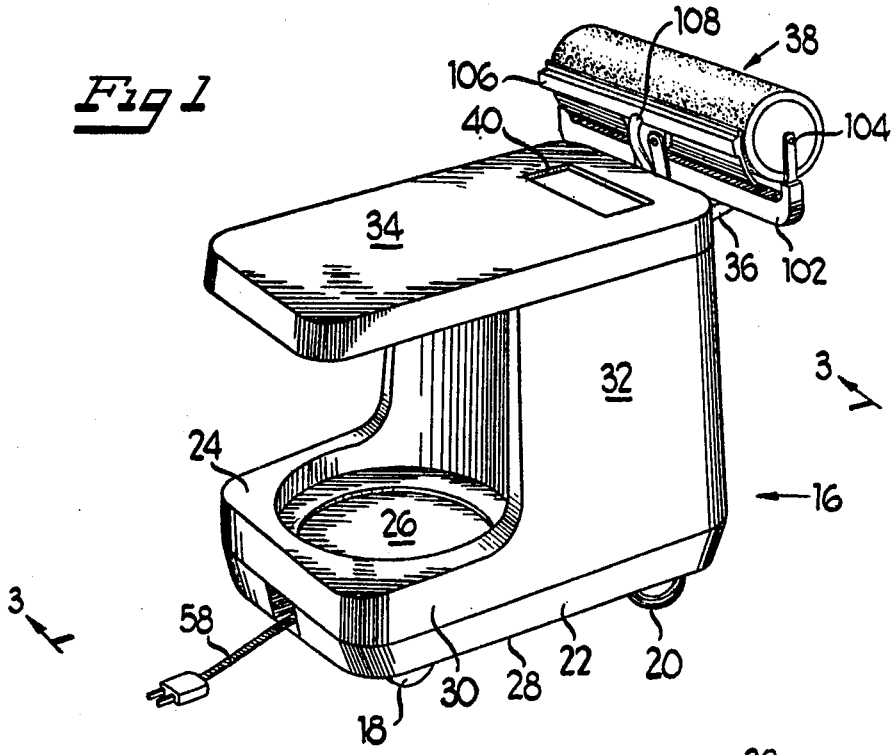
FIGS. 1 and 2 are perspective views of an embodiment of this invention.
Figure 2:
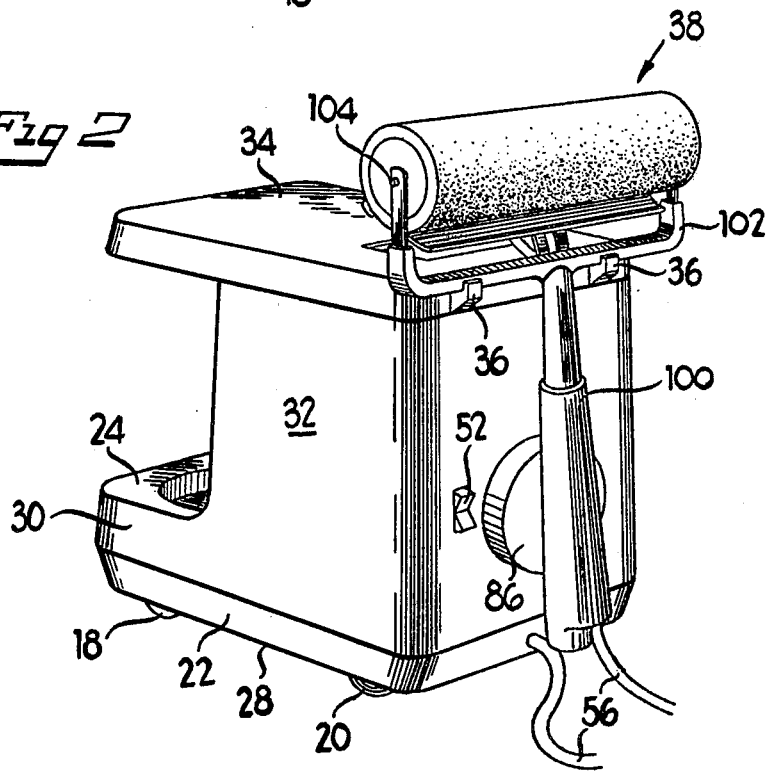

Turning first to FIGS. 1 and 2, an embodiment of the present invention is shown having a case or carriage 16 for containing a supply of paint and a paint applicator in the form of a paint roller for receiving the paint from the paint supply for application to a surface. The carriage 16 is equipped with wheels 18 and swivel casters 20 (see also FIGS. 3 and 4). The casters 20 provide for easier directing or steering of the device as it is moved over a flat surface such as a floor or the like, with the casters at the leading end. Of course skids or other members can be used for supporting the case or carriage 16.

The carriage 16 includes a base portion 22 having a platform 24 with a paint well 26 sunken therein. A bottom plate 28 supports a skirt 30 which in turn supports the platform 24. The wheels 18 and casters 20 are secured to the bottom plate 28.

The carriage also has a hood portion 32 which upstands from the base portion 22. The side walls and end wall of the hood portion 32 preferably are molded of plastic or like material integral with the skirt 30 and platform 24. The hood portion also includes a roof 34 supported by the side and end walls.

Figure 3:
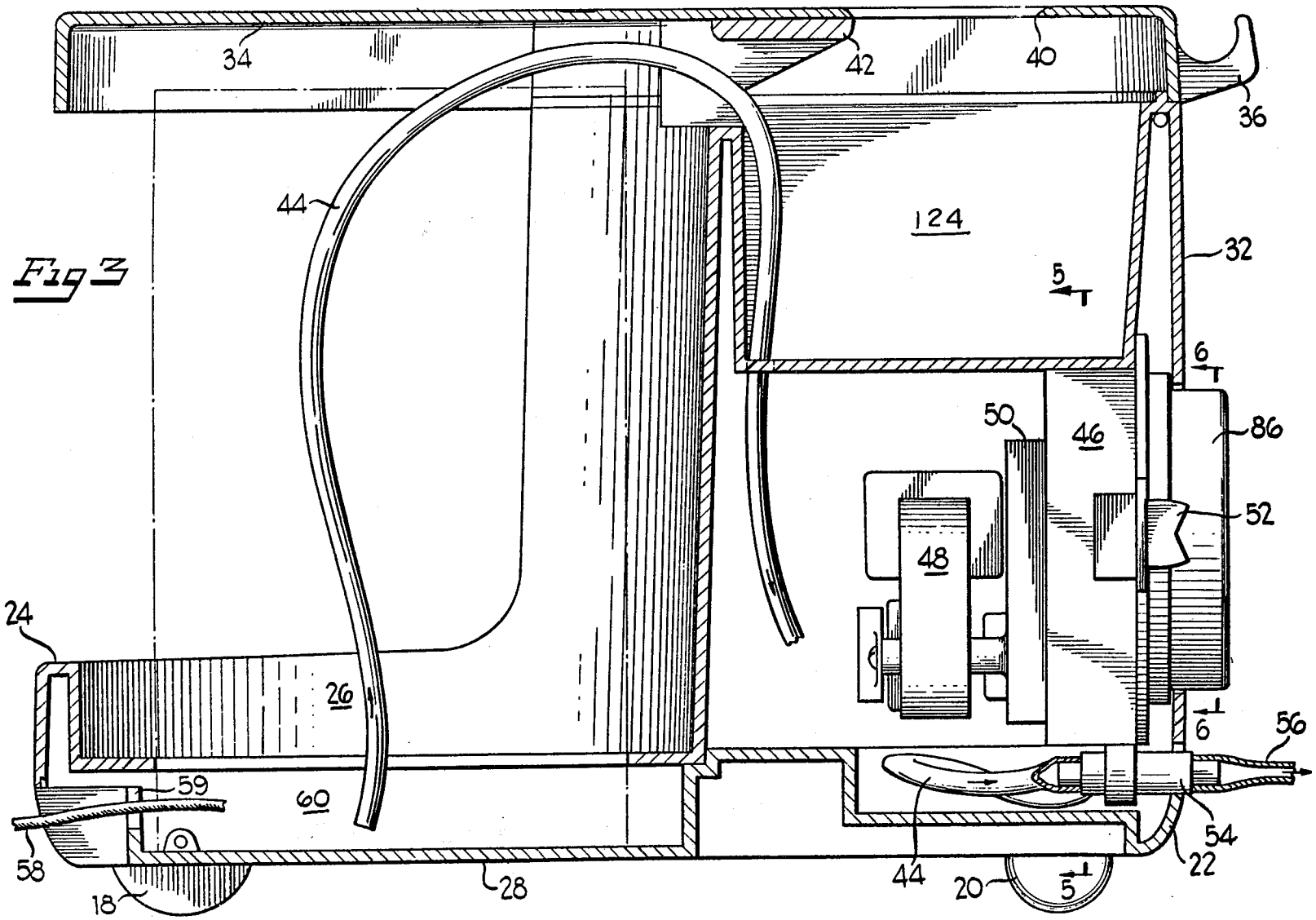
FIG. 3 is an enlarged sectional view taken generally along the line 3—3 of FIG. 1, showing a casing or carriage portion of the embodiment, with the paint roller portion removed.

A pair of hook members 36 ar secured to the leading end of the roof portion 34 of carriage 16 (see FIGS. 2 and 3). A paint applicator 38 is the form of a paint roller is removably held by the hook members 36.

Referring to FIGS. 1 through 4, roof 34 has an access port or opening 40 for access to an interior grippable bar 42, providing convenient means for manually transporting the case or carriage 16. The user inserts a hand through opening 40 and grips bar 42 which functions as a handle for lifting the carriage 16.

Figure 4:
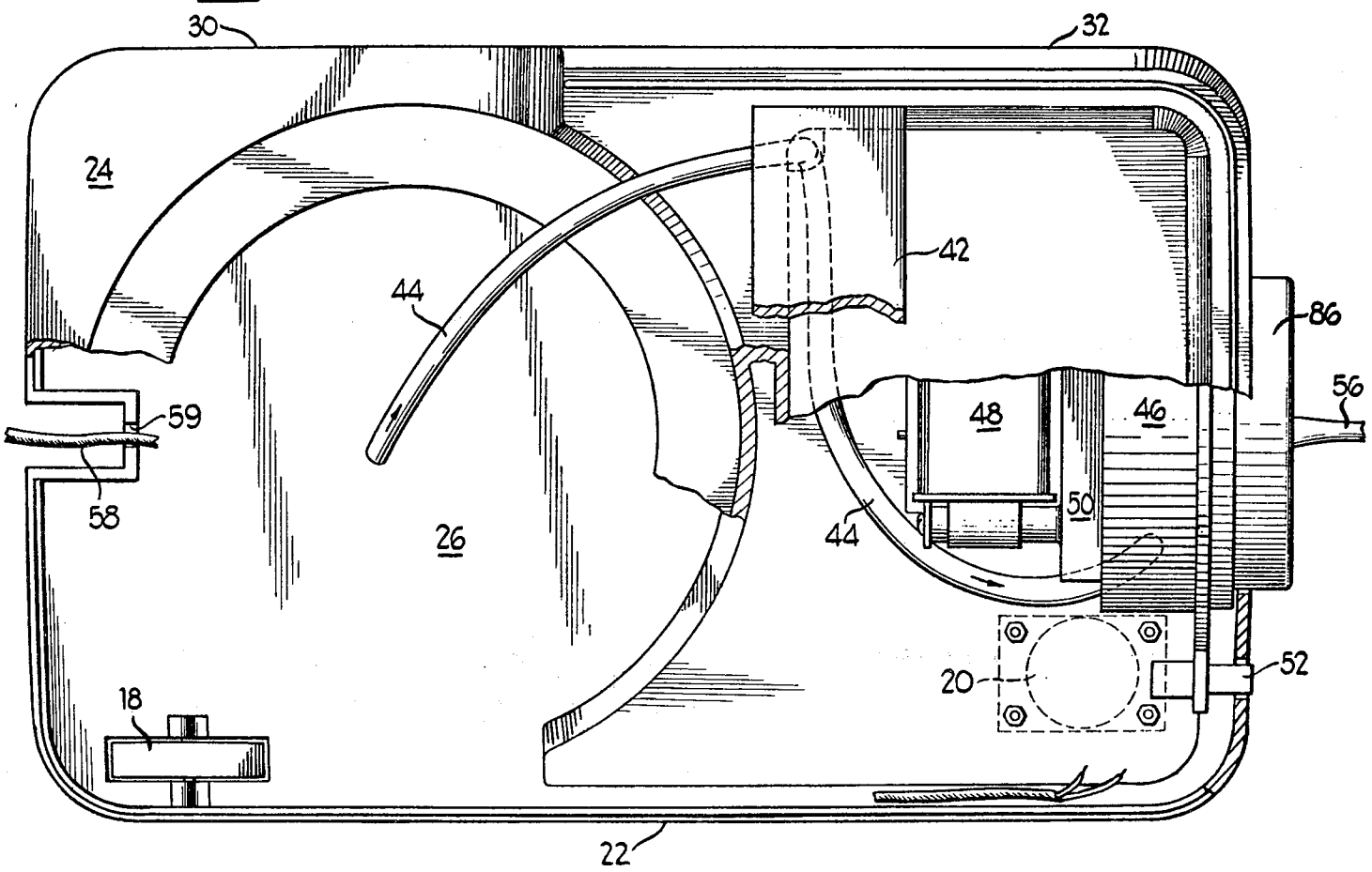
FIG. 4 is a fragmentary top plan view of the embodiment in the same scale as in FIG. 3.

Also as seen in FIGS. 3 and 4, a conduit in the form of a flexible plastic hose or tube 44 extends from the paint well 26 through a peristaltic pump 46. The pump is driven by an electric motor 48 through a reducing gear box 50 and the motor is controlled by an on-off switch 52. Conduit 44 extends from pump 46 to a fitting 54 in the wall of base portion 22. The fitting 54 is releasably force fit at the exterior of the wall into a flexible tube 56 which extends to the paint roller 38 (FIGS. 1 and 2). The electric motor 48 is supplied with current through an electric cord 58 (FIGS. 1, 3 and 4) which can be manually retracted through a port 59 into a storage compartment 60 in base portion 22. The cord plug is larger than port 59 so that the entire cord 58 will not retract and become non-retrievable within compartment 60.

Figure 5:
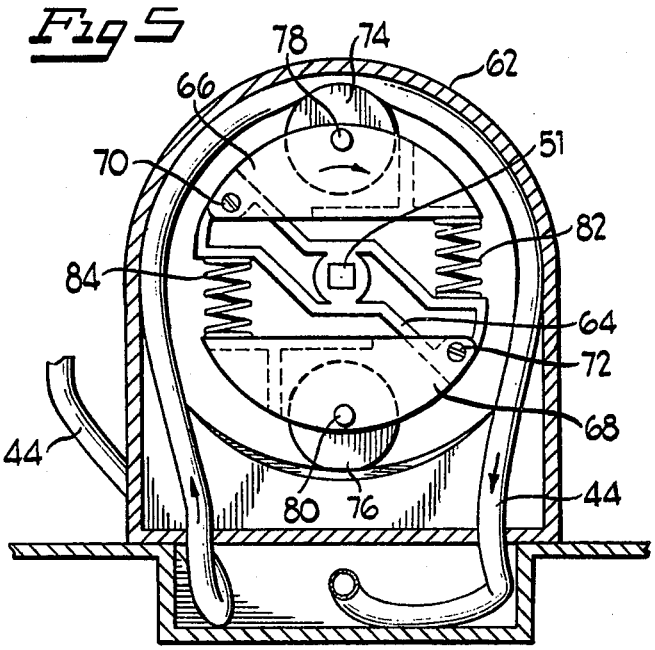
FIG. 5 is a section through the peristaltic pump portion of the embodiment taken along line 5—5 of FIG. 3.

The peristaltic pump 46 is shown in more detail in FIG. 5. The pump includes a casing 62 having an upper curved wall along the interior of which flexible tube 44 extends. The pump includes an elongate propeller-like frame member 64 which is mounted on shaft 51, driven by motor 48 through gear box 50 in a clockwise direction as viewed in FIG. 5. Opposing arms 66 and 68 are pivotally mounted at 70 and 72 to the opposite ends of the frame member 64. Each arm 66, 68 has a roller 74, 76 mounted thereon by an axle 78, 80. The free ends of the arms 66, 68 are biased away from the frame member 64 by compression springs 82, 84 to normally urge rollers 74, 76 into pressing contact with the flexible tube 44 as frame member 64 is rotated.

In operation of the pump, as indicated, frame member 64 is driven in a clockwise direction (FIG. 5) carrying arms 66, 68 and rollers 74, 76 therewith. The rollers 74, 76 engage and compress the tube 44 alternately during rotation of the frame 64 and urge liquid through the tube 44 in a peristaltic manner. The liquid is delivered through fitting 54 and tube 56 to the paint roller assembly 38.

Figure 6:
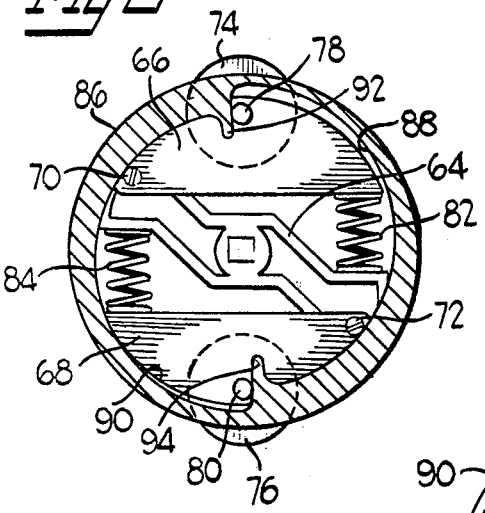
FIGS. 6 and 7 are sectional views taken generally along line 6—6 of FIG. 3 showing positions of the cover member of the pump in pumping and non-pumping positions, respectively.
Figure 7:
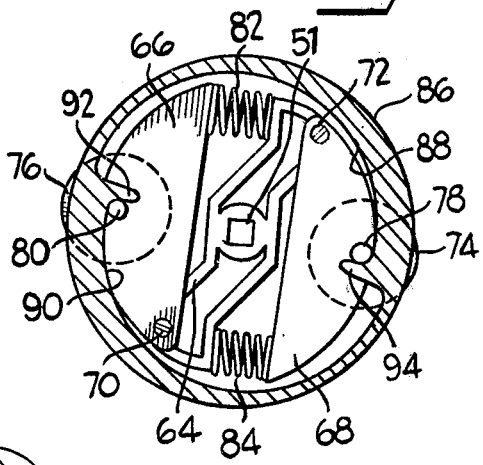
Figure 8:
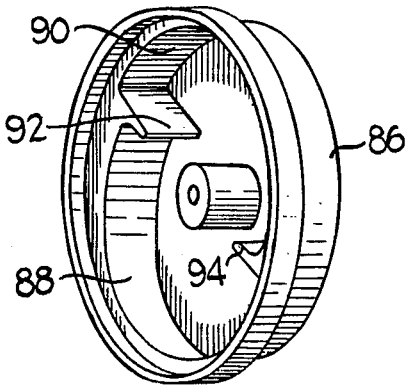
FIG. 8 is a perspective view of the cover portion of the pump shown in FIGS. 6 and 7.

As seen generally in FIGS. 2 through 4, the peristaltic pump is provided with a cap member 86 projecting through an opening to the exterior of the end wall of hood 32 so as to be manually accessible from the exterior of carriage 16. Turning now to FIGS. 6 through 8, the cap and its function will be explained in more detail. Th cap 86 is mounted on shaft 51 which drives the pump 46 so that cap 86 is rotating while the pump is being driven. When the motor 50 is turned off by manually operable switch 52 and the pump is stopped the cap 86 can be manually indexed for the purpose of disengaging the rollers 74 and 76 from tube 44 to provide free passage of fluid through tube 44. Tube 44 can then be completely flushed with a suitable paint solvent, e.g., water for latex paint, so that the carriage 16 can be stored with tube 44 in a clean condition. For this purpose cap 86 is provided with opposed inwardly directing cam surfaces 88 and 90 engaging extensions of axles 78 and 80, respectively. As cap 86 is rotated counterclockwise from its position shown in FIG. 6 to its position shown in FIG. 7, the axles 78 and 80 ride up the cam surfaces 88 and 90 forcing the axles inwardly and retracting the rollers 74 and 76 from their position of engagement with tube 44. Stop blocks or abutments 92 and 94 are provided at the ends of the cam surfaces 88 and 90 to prevent override of the axles 78 and 80 beyond the respective cam surfaces. Tube 44 can now be flushed as described above.

Turning now to FIGS. 2 and 9 through 11, the paint roller assembly 38 includes a hollow handle 100 with a yoke 102 attached to the upper use end thereof, mounting a shaft 104. Also attached to handle 100 by a leaf spring 103 is a manifold 106 which receives paint from a supply tube 108 threaded through the interior of hollow handle 100. The paint is supplied from the peristaltic pump through tube 56, then through fitting 109 and into tube 108.

The paint roller is mounted on axle 104 and includes a core member 110 and an absorbent cover 112. Any conventional paint roller of proper size can be used. The bifurcated leaf spring 103 has its base secured to the handle 100 and extends to and is secured to manifold 106 to press manifold 106 against cover 112. A trough 113 is secured to manifold 106 and extends beneath the paint roller when the paint roller is in upright position to catch any drippage from cover 112.

Figures 9, 10, 11:
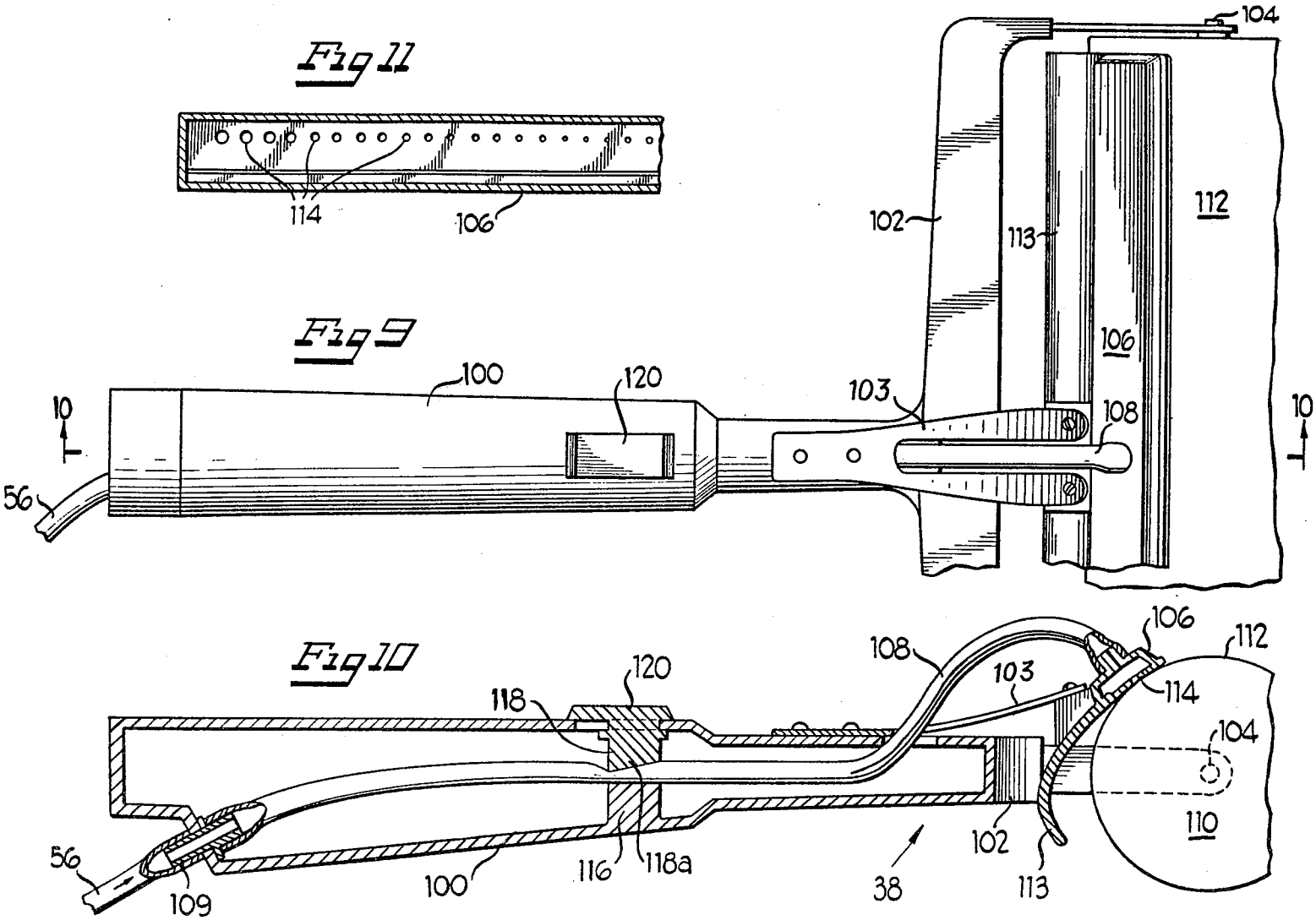
FIG. 9 is an enlarged fragmentary plan view of the paint roller, handle and associated members shown in the embodiment in FIGS. 1 and 2.
FIG. 10 is a partial section taken generally along the line 10—10 of FIG. 9.
FIG. 11 is a partial section through the manifold portion of the paint roller assembly shown in FIGS. 9 and 10.

Referring now especially to FIG. 11, th manifold 106 has a linear array of emission ports graduated in size from small near the center of the manifold 106 and larger toward each end. It will be seen from FIG. 9 that the supply tube 108 enters the manifold at the center thereof and the gradation of the paint emission ports in manifold 106 is for the purpose of assuring even distribution of paint over the width of the cover 112 on the paint roller. Considering that the paint is a viscous liquid it will be apparent that the emission pressure caused by paint entering from line 108 will be greater in the center of the manifold than at the ends so that larger emission ports 114 are provided toward the ends of the manifold for proper even distribution.

A control valve system is provided controlling the flow or rate of flow through tube 108, into manifold 106 and thence to absorbent cover 112. The flow control system is manually operable at handle 100 and is designed to prevent over-saturation of cover 112 with paint which may otherwise occur. Accordingly a block 116 is mounted within handle 100, secured against movement. A cam member 118 and attached slide button 120 are slidably mounted in the handle wall so that slide button 120 is accessible from the exterior of handle 100. The cam member 118 has a bevelled cam surface at **118*a* (FIG. 10). In FIG. 10, the valve or control system is shown in closed position with button 120 moved to its upward extent so that cam surface 118*a* pinches tube 108 against block 116 to close tube 108 and shut off flow to manifold 106. When button 120 is slid downwardly in FIG. 10, cam surface 118*a* releases the pinching action of tube 108 between cam 118 and block 116 permitting free flow of paint through the tube 108 and into the manifold for application to the roller cover 112. Intermediate positions permit varying degrees of flow. Thus the operator of the paint applying apparatus can regulate the flow of paint or stop it entirely by use of button 120 at handle 100**.

After use of the device the entire system can be flushed with the flow control valve open or tube 56 can be disconnected from fittings 54 and 109 and the individual tube portions can be cleaned separately. Additionally, as best seen in FIG. 3, a storage compartment 124 is provided for storing tube 56 or even tube 44 if and when disconnected. The storage compartment 124 is accessible through hand receiving opening 40.

The foregoing detailed description has been given for clearness of understanding only and no unnecessary limitations should be understood therefrom as some modifications will be obvious to those skilled in the art.

We claim:

1. Apparatus for applying paint or other fluid material to a surface, which apparatus comprises a wheeled carriage for movement along a floor or other generally flat surface, said carriage including a base element supported by wheels and having a well for receiving a paint pail or the like, peristaltic pump means mounted on said carriagne including a flexible conduit for delivering fluid therethrough from the pail positioned in said well, and applicator means having a paint absorbent surface and manifold means for receiving paint from said conduit and distributing the paint evenly over said absorbent surface, wherein said applicator means is a paint roller having a bifurcated yoke with a handle secured thereto and said manifold means is formed by said yoke, a hood element upstanding from said base and overlying said well at a height above said paint pail, said hood includes a hook means for engaging and hanging said paint roller by its manifold in upright position, said hood element includes a top aperture and a grippable element whereby a hand inserted through the aperture can grip the grippable element for purposes of moving said carriage.

2. The apparatus of claim 1 wherein said hood includes a hook means for engaging and hanging said paint roller by its manifold in upright position.

3. The device of claim 1 wherein said hood element includes a top aperture and a grippable element whereby a hand inserted through the aperture can grip the grippable element for purposes of moving said carriage.

4. Apparatus for applying paint or other fluid material to a surface, which apparatus comprises: a portable case member, said case member including a base element having a well for receiving a paint pail or the like, a hood element upstanding from said base and overlying said well at a height above said paint pail, pump means mounted to said case member including a conduit for delivering fluid therethrough from the paint pail positioned in said well, applicator means in the form of a paint roller having a bifurcated yoke secured to a handle and having a paint absorbent surface on the roller, and manifold means for receiving paint from said conduit and distributing the paint evenly over said absorbent surface.

5. The apparatus of claim 4 wherein said applicator means is a paint roller having a bifurcated yoke with a handle secured thereto.

6. The apparatus of claim 5 wherein said conduit delivers paint to approximately the center of said manifold and said manifold has paint delivery ports increasingly graduating in size from the center thereof to each end thereof for even delivery of paint over the width of the paint roller.

7. The apparatus of claim 6 including a trough member secured to said manifold below said roller with said handle in normal upright use position, and said roller at the top thereof, said trough extending between said roller and handle along the width of the roller for catching drippage from the roller.

8. Apparatus for applying paint or other fluid material to a surface, which apparatus comprises a wheeled carriage for movement along a floor or other generally flat surface, said carriage including a base element supported by wheels and having a well for receiving a paint pail or the like, peristaltic pump means mounted on said carriage including a flexible conduit for delivering fluid therethrough from the pail positioned in said well, applicator means having a paint absorbent surface and a handle through which said conduit extends and manifold means secured to said handle for receiving paint from said conduit and distributing the paint evenly over said absorbent surface, and manually operable flow control means on said handle including a manually accessible slide button slidably mounted on said handle and terminating within said handle in a wedge-like cam surface engaging said flexible tube for pinching said flexible conduit against a block within said handle to stop or control the rate of flow through said conduit to said manifold.

9. Apparatus for applying paint or other fluid material to a surface, which apparatus comprises a wheeled carriage for movement along a floor or other generally flat surface, said carriage including a base element supported by wheels and having a well for receiving a paint pail or the like, applicator means having a paint absorbent surface and manifold means for receiving paint and distributing the paint evenly over said absorbent surface and peristaltic pump means mounted on said carriage including a flexible conduit for delivering fluid therethrough from the pail positioned in said well to said manifold means, said peristaltic pump comprising a semi-circular casing having the circular portion of its wall lined with said flexible conduit, a motor driven propeller mounted co-axially within said casing, said propeller having distal ends opposing each other and an arm pivotally mounted on each of said ends, compression spring means normally biasing the arms away from each other so as to urge said arms toward said conduit, a roller mounted on each arm, each mounted by an axle for rotational movement and in engagement with said conduit under biasing of said spring means during rotation of said propeller whereby rotation of said propeller causes the rollers to alternately roll against the inner surface of said flexible conduit and produce a peristaltic pumping action to force fluid through the conduit, and pressure release means acting against said spring means for pivotally moving said arm members toward each other against the biasing of said spring means to relieve pressure of said rollers on said conduit and thereby stop the peristaltic pumping action through said conduit so that cleaning fluid can be directed through said conduit for cleaning purposes, said pressure release means including a cap mounted co-axially with said propeller and rotatable relative thereto, said cap having a peripheral circular wall with internal cam surfaces each engaging one of said axles for moving an axle and roller inwardly and away from engagement with said conduit upon rotation of said cap relative to said propeller.

10. Apparatus for applying paint or other fluid material to a surface, which apparatus comprises: a portable case member, said case member including a base element having a well for receiving a paint pail or the like, and a peripheral skirt, pump means mounted to said case member, a conduit for delivering fluid therethrough from the paint pail positioned in said well, applicator means having a handle and a paint absorbent surface, manifold means for receiving paint from said conduit and distributing the paint evenly over said absorbent surface, said conduit including a flexible tube extending from the paint pail to a fitting impaling the skirt element and a flexible tube extending from said fitting through the paint applicator handle and connected to the midportion of said manifold, and a hood element upstanding from said base and overlying said well at a height above said paint pail, said hood element including a hook means for engaging and hanging said paint roller by its manifold in upright position.

11. Apparatus for applying paint or other fluid material to a surface, which apparatus comprises: a portable case member, said case member including a base element having a well for receiving a paint pail or the like, and a peripheral skirt, pump means mounted to said case member, a conduit for delivering fluid therethrough from the paint pail positioned in said well, applicator means having a handle and a paint absorbent surface, manifold means for receiving paint from said conduit and distributing the paint evenly over said absorbent surface, said conduit including a flexible tube extending from the paint pail to a fitting impaling the skirt element and a flexible tube extending from said fitting through the paint applicator handle and connected to the midportion of said manifold, and a hood element upstanding from said base and overlying said well at a height above said paint pail, said hood element including a top aperture and a grippable element whereby a hand inserted through the aperture can grip the grippable element for purposes of moving said carriage.

12. Apparatus for applying paint or other fluid material to a surface, which apparatus comprises: a wheeled carriage for movement along a floor or other generally flat surface, said carriage including a base element supported by wheels and having a peripheral skirt and a well for receiving a paint pail or the like, peristaltic pump means mounted on said carriage including a flexible conduit for delivering fluid therethrough from a pail positioned in said well, applicator means having a paint absorbent surface and manifold means for receiving paint from said conduit and distributing the paint over said absorbent surface, said applicator means comprising a paint roller having a bifurcated yoke with a handle secured thereto, said conduit delivering paint to approximately the center of said manifold and said manifold having paint delivery ports increasingly graduating in size from the center thereof to each end thereof for even delivery of paint over the width of the paint roller, a trough member secured to said manifold below said roller with said handle in normal upright use position with the roller at the top thereof, said trough extending between said roller and said handle along the width of the roller for catching drippage from the roller, and hood member upstanding from said base and overlying said well above paint pail level, hook means on said hood member for engaging and hanging said paint roller by its manifold in upright position, said hood member including a top aperture and a grippable element whereby a hand inserted through the aperature can grip the grippable element for purposes of moving said carriage, said handle being mounted to said manifold with a bifurcated leaf spring having its base secured to the handle and extending to and secured to said manifold, said handle being hollow and said conduit extending through the length of the handle and into the manifold, said handle also including slidably mounted cam means engaging said flexible tube for pinching said flexible tube to stop or control the rate of flow therethrough from said peristaltic pump, said pump comprising a semi-circular casing having its circular top wall lined with said flexible conduit, a motor driven propeller mounted co-axially within said casing, said propeller having two distal ends opposing each other by about 180°, an arm pivotally mounted on each of said distal ends, a compression spring biasing each arm away from the opposite end of the propeller so as to urge said opposite ends normally away from said propeller and toward said conduit, a roller mounted on each arm for rotational movement in engagement with said conduit whereby rotation of said propeller causes said rollers to alternatively roll against said flexible conduit and produce a peristaltic pumping action to force fluid through the conduit, and pressure release means for said rollers acting against said spring means for pivotally moving said arm members toward each other to relieve pressure of said rollers on said conduit and thereby stop the peristaltic pumping action through said conduit, said pressure release means comprising a rotatable cam member in the form of a cover manually accessible from the exterior of said carriage, said cover being rotatable about the same axis as said propeller and having two inwardly convoluted cam surfaces, each approximately 180°, for engaging the axles of said two rollers and urging said axles and rollers inwardly toward each other during an approximate 180° rotation of said cover whereby said arms are moved toward each other and toward the propeller and said springs are compressed.

13. The apparatus of claim 12 wherein said carriage further includes an integral upstanding hood in the form of a container for containing the conduit when detached from said carriage and applicator.

* * * * *